United States Patent [19]

Schmitt

[11] Patent Number: 4,522,021

[45] Date of Patent: Jun. 11, 1985

[54] STATIONARY SPINDLE BRAKE FOR SPINNING AND TWISTING SPINDLES

[75] Inventor: Günther Schmitt, Hammelburg, Fed. Rep. of Germany

[73] Assignee: FAG Kugelfischer Georg Schafer, Kommanditgesellschaft auf Aktien, Fed. Rep. of Germany

[21] Appl. No.: 613,514

[22] Filed: May 23, 1984

[30] Foreign Application Priority Data

Jun. 7, 1983 [DE] Fed. Rep. of Germany ..... 3320458

[51] Int. Cl.[3] ..... D01H 7/22

[52] U.S. Cl. ..... 57/88; 57/104; 57/105

[58] Field of Search ..... 57/88, 89, 78, 80, 104, 57/105

[56] References Cited

U.S. PATENT DOCUMENTS 3,224,180 12/1965 Graf ..... 57/88
3,256,684 6/1966 Stahlecker et al. ..... 57/88
3,382,661 5/1968 Davies ..... 57/88 X
4,103,479 8/1978 Stahlecker et al. ..... 57/88 X
4,445,320 5/1984 Oppl et al. ..... 57/88

*Primary Examiner*—John Petrakes
*Attorney, Agent, or Firm*—Ostrolenk, Faber, Gerb & Soffen

[57] ABSTRACT

A series of spindles is supported on a rail. A spindle brake is provided for acting on a selected one of a pair of spindles which are driven to rotate by a belt. The spindle brake is supported on a holder. The holder is pivoted to the rail. A pair of levers pivotally attached to the holder are respectively pulled for pivoting the holder in one and the opposite directions. A brake element is supported to the holder. The brake element includes a brake surface. Pivoting of the holder pivots the brake element to bring the brake surface into braking engagement with the respective spindle. A belt lift-off roller is pivotally supported to the holder on an axis spaced from the holder axis and is so shaped and placed that pivoting of the holder to brake a particular spindle moves the belt lift-off roller to lift the belt off that particular spindle.

12 Claims, 4 Drawing Figures

STATIONARY SPINDLE BRAKE FOR SPINNING AND TWISTING SPINDLES

BACKGROUND OF THE INVENTION

The present invention relates to a stationary spindle brake for spinning and twisting spindles and the brake is particularly useful for hollow spindles. The brake is useful for spindles used in providing a false twist to filaments used in making yarn.

Various lever actuated spindle brakes are known. Federal Republic of Germany Application DE-OS No. 29 39 862 describes a spindle brake, which actuates both an inside and an outside brake jaw via a lever mechanism. During the braking process, the drive belt for the spindles is not lifted off the drive whorl on the drive shaft. This results in increased development of heat, which has a negative effect on the spindle and leads to its premature failure. In addition, both brake jaws act in a direction which also leads to a higher bearing load. The construction of this brake device is very involved and thus expensive, particularly since a complete device is required for each spindle.

Federal Republic of Germany Published Application DE-AS No. 26 28 125, describes a brake device which is also actuated via a lever mechanism. Here, before the spindle is braked, it is lifted axially off the drive belt. This is a very expensive construction that has the further disadvantage that upon each braking operation, the spindle must be brought out of its position. This is not advantageous for a spindle, which is a highly precise machine part.

Machines are known, for instance covering machines, which have spindles that are arranged in two rows, staggered one behind the other, on a spindle rail.

The front spindles can be stopped by a movable or a stationary brake and are easily accessible. Access to the rear row of spindles is more difficult and the action upon the rear spindles must not influence the front spindles.

SUMMARY OF THE INVENTION

The object of the present invention is to eliminate the disadvantages described above and to create, with a simple construction, a brake which can be used for two spindles.

According to the invention, there are at least one pair of spinning spindles, such as those used in applying a twist or a false twist to the filaments used in producing yarn of artificial material, supported on a common supporting rail means. The brake of the invention is designed for cooperating with the pair of spindles, and the brake is disposed between these spindles. The spindles of interest are driven by an endless belt which contact and moves past the spindles to spin them.

The brake of the invention includes a holder which is pivotally mounted to the supporting rail means at a location between the two spindles, and the holder is pivotable toward each of the two spindles of the pair. A brake element is mounted on the holder to pivot with the holder. A brake surface on the brake element is adapted for engaging a selected one of the spindles as the holder pivots the brake element, whereby the brake surface rubbing the spindle brakes the rotation of the selected spindle. The brake element may be comprised of resilient material to avoid excess loading on the spindle being braked. The holder also supports a belt lift-off roller, and that roller contacts the belt when the holder pivots the brake surface toward the spindle for lifting the belt off the spindle being braked. The belt lift-off roller is freely rotatable on a pivot that is spaced from the pivot of the holder so that the belt lift-off roller will be moved to the belt lift-off position as the holder pivots.

Lever means are provided for effecting the pivoting rotation of the holder. The lever means are supported on the rail support means and the lever means are pivotally connected to the holder for causing the holder to pivot as the lever means are operated. In particular, the lever means comprise a pair of levers placed so that pulling on each of the levers pivots the holder in the one direction or the opposite direction, respectively. A spring biased knob is operated against the rail support means for holding the holder pivoted in the selected pivot direction. Various adjustments of the lengths of the holders and of the position of the brake element on the holder adjusts for desired brake pressure and for different size spindles.

Other objects and features of the invention are explained below with reference to an embodiment illustrated in the drawings.

DESCRIPTION OF THE PREFERRED EMBODIMENTS

Figure 1:
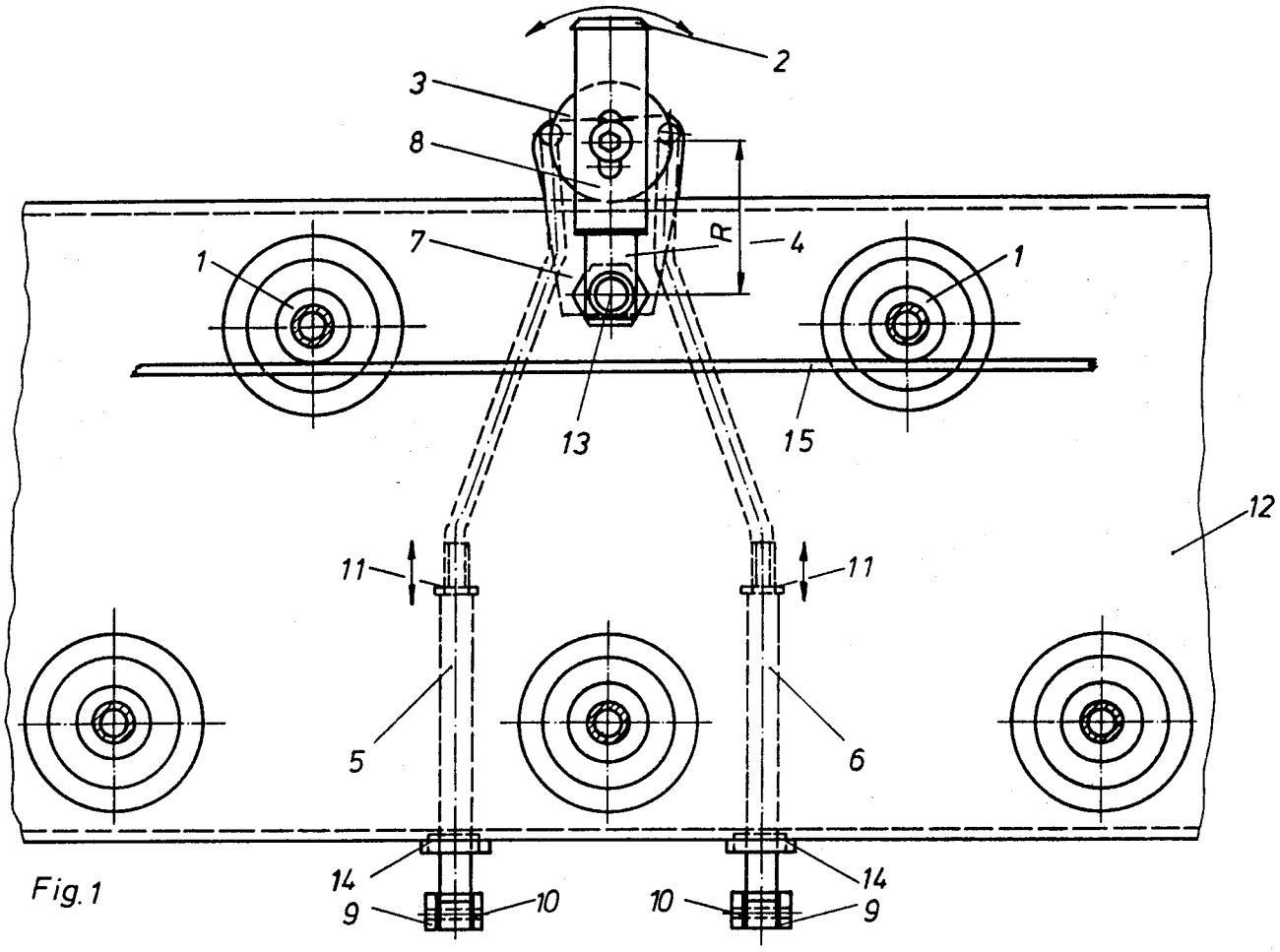
FIG. 1 is a top view of a double-row spindle rail showing a spindle brake according to the invention in its position of rest.
Figure 2:
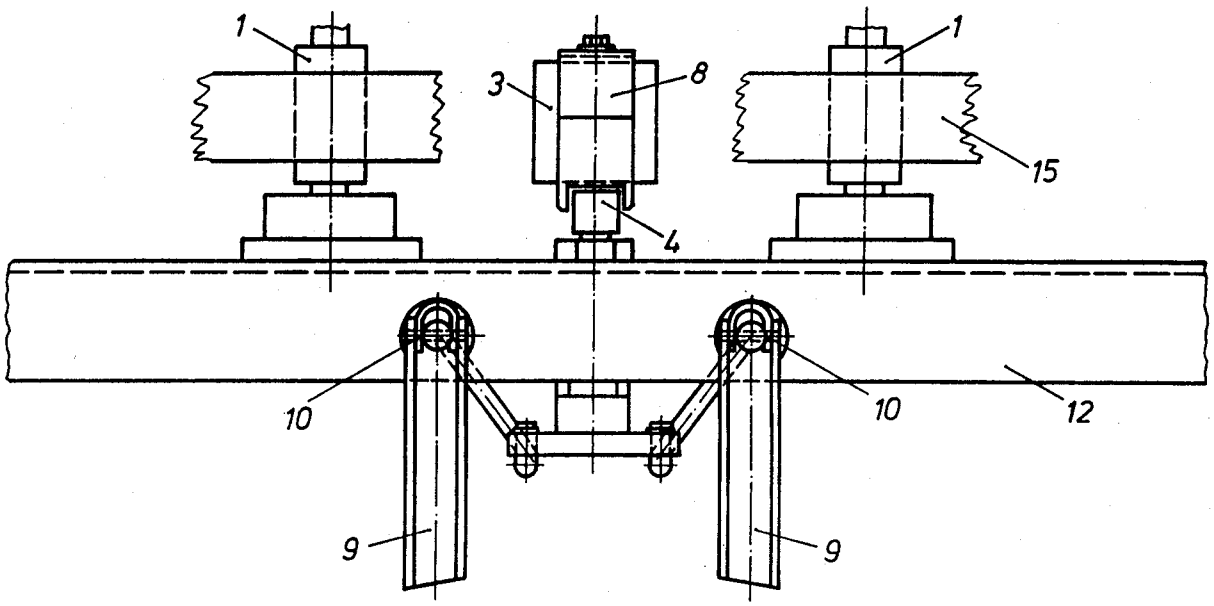
FIG. 2 is a front view of the spindle brake of FIG. 1 in its position of rest.

Referring to FIGS. 1 and 2, there is a spindle supporting rail 12 on which a plurality of spindles 1 are supported. Two of the spindles 1 are driven by the single tangential belt 15 of which only a part is shown. The drive belt 15 has been partially omitted for clarity. The belt engages the drive whorls of the spindles. These two spindles are positioned to the left and the right of the spindle brake of the invention.

There is a holder 4 which is supported above the rail 12 to pivot in direction around pivot 13. The holder 4 supports a lift-off roller 3 and also supports a resilient brake element 8, which has the brake surface 2 fastened on it. The brake element 8 is resilient, e.g. it is a U-shaped spring plate, to avoid excessive loading of the spindle upon the braking. The roller 3 is supported for freely rotating on a shaft at its center. That shaft is supported on the holder 4 eccentric of the pivot 13. The brake element 8 is also carried on and adjustably fixed on that same supporting shaft as the roller 5. There are two stop-motion levers 5 and 6 which lie below the spindle rail 12. These levers are turnably mounted in a base plate 7 and are also guided in the bushings 14 located in the front flange of the spindle rail 12. Pulling on each of the levers 5, 6 moves the holder 4 around pivot 13 in a respective direction. There is also a fine adjustment 11 for the stop-motion levers 5 and 6. A respective torsion spring 10 and operating knob 9 are connected to each of the stop-motion levers 5 and 6 by an ordinary cylindrical pin. The knobs lock their respective levers at a pulled orientation, as described below. The base plate 7 as well as the holder element 4 have the common pivot 13.

Figure 4:
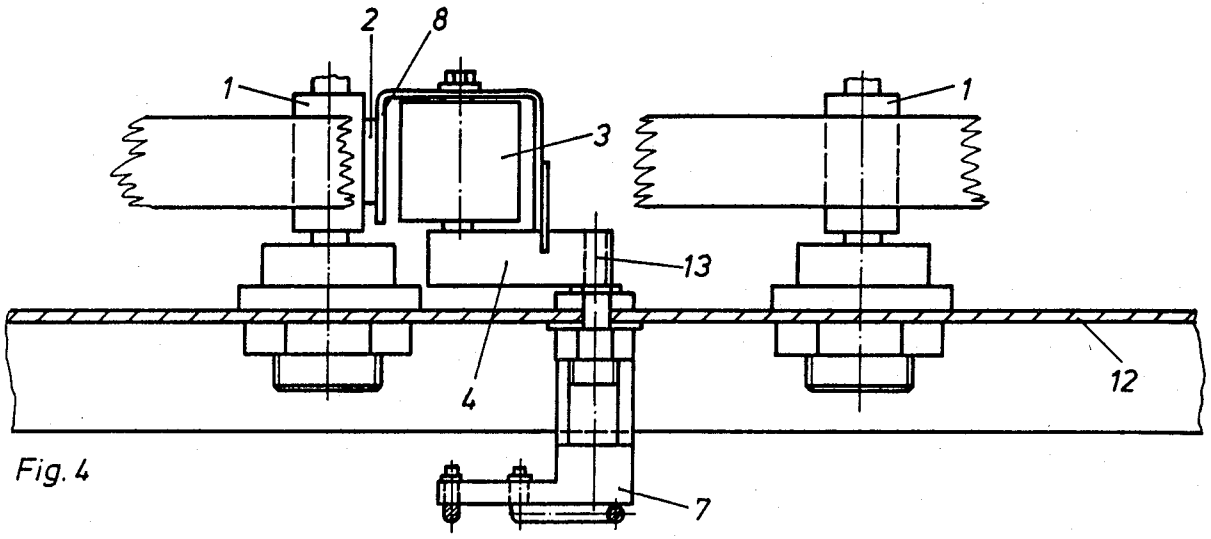
FIG. 4 is a cross sectional view through the spindle rail, with the brake in its braking position.

As shown in FIG. 4, the holder 4 above the rail 12 and the base plate 7 below the rail are mounted turnably at the pivot point 13. The resilient brake element 8 to which the brake surface 2 is fastened is held centrally over the lift-off roller 3. The base plate 7 receives the stop-motion levers 5 and 6 via a traditional cylindrical pin.

Figure 3:
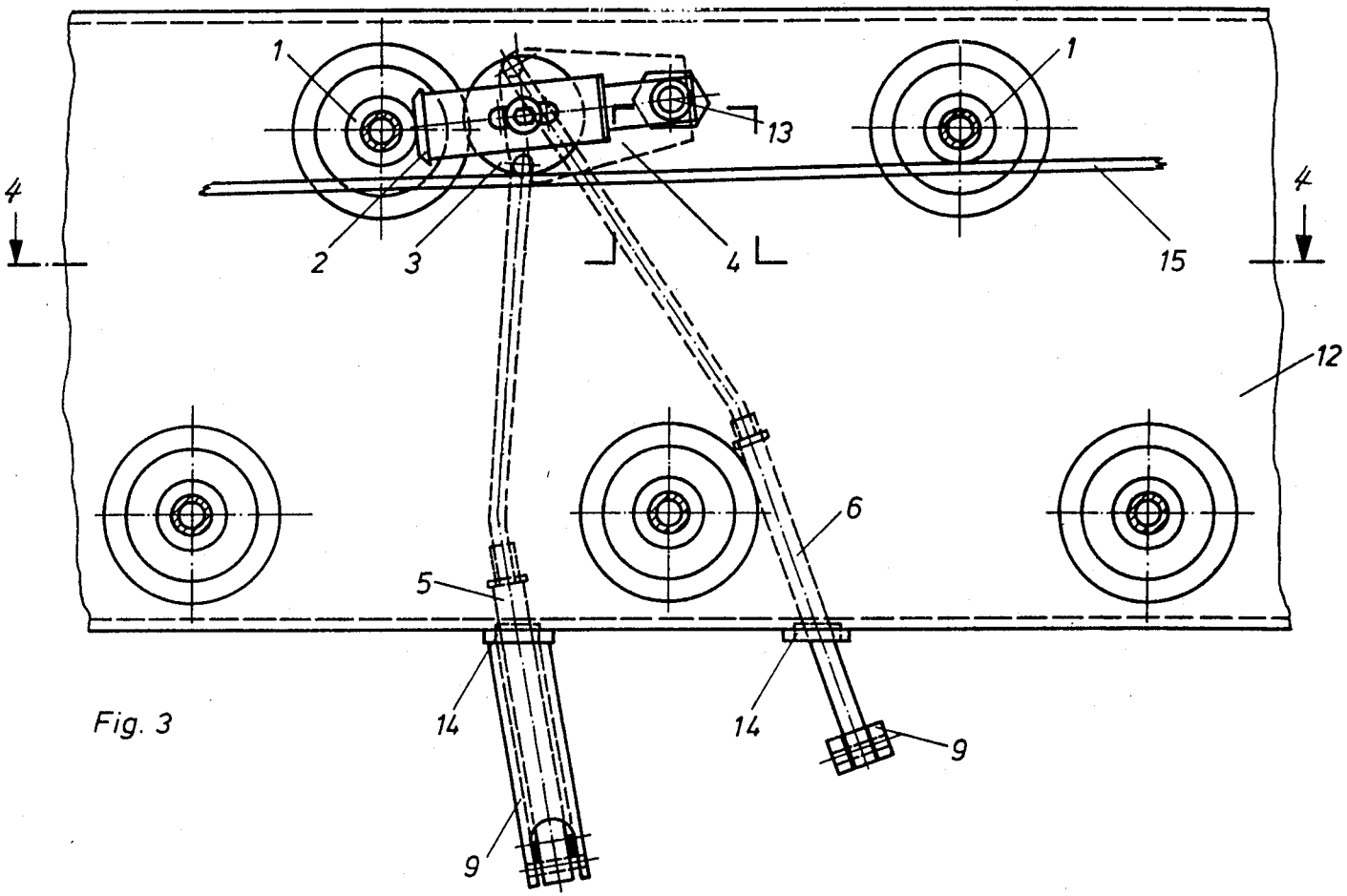
FIG. 3 is a top view of the spindle brake of FIG. 1 in one of its braking positions.

FIG. 3 shows the spindle brake in operation. The holder 4 and brake element has been rotated around the pivot 13 toward the left side spindle 1 by the respective lever. The brake surface 2 lies against the spindle drive whorl. At the same time, the lift-off roller 3 has been pivoted for enough to lift the drive belt 15 off from the drive whorl of that spindle. The previously downwardly hanging operating knob 9 (FIG. 2) is pivoted up to be applied against the edge of the spindle rail 12, and this locks the spindle brake in its position of FIG. 3.

The right spindle is not affected.

The manner of operation of the spindle brake is now described. The brake device is optionally rotated to the left spindle or to the right spindle 1 around the common pivot point 13 of the holder 4 and the base plate 7 by a pull on the corresponding movement knob 9. The brake surface 2 is thereby brought against the drive whorl of the selected spindle 1 to cause that spindle to stop.

At the same time, the drive belt 15 is lifted by the lift-off roller 3 a few millimeters away from the spindle whorl to avoid the additional development of heat that results from the sliding of the drive belt on the drive whorl of the braked spindle.

After the spindle has been braked, the operating knob 9 is so swung by the compression spring 10 that it comes to rest against the spindle rail 12. In this way, the brake is locked and cannot loosen by itself. In order to place the braked spindle in operation again, the operating knob 9 is lifted forward off the spindle rail 12 and is brought, by pushing, to the point of engagement. The brake is now seated free between the two spindles.

The fine adjustment 11 is for optimally adjusting the lever mechanism 5 and 6 and the lift-off roller 3. It also adjusts the braking distance and it help assure that only one of the two brakable spindles is braked at one time.

This brake can be used for spindle whorls of any diameter. This is done through shifting the brake element 8 with respect to the pivot shaft of the roller 3, which is permitted by the elongated slot in the element 8. The lift-off path for the drive belt is also adjustable.

By the present invention there is created a simple, economic spindle brake which can be operated easily and reliably.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A spindle brake for braking a selected one of a pair of spinning spindles, wherein the pair of spindles are supported on support rail means; a belt for contacting the spindles and moving therepast to spin both of the spindles of the pair;

the brake comprising:

a holder pivotally mounted to the rail means between the spindles of the pair, the holder being pivotable toward either spindle;

a brake element mounted on the holder and pivotable therewith; a brake surface on the brake element, the brake surface being so placed on the brake element and the brake element being so placed and shaped that upon rotation of the holder around its pivot in one direction, the brake surface contacts one of the spindles to rub and brake the one spindle, and upon rotation of the holder around its pivot in the opposite direction, the brake surface contacts the other spindle to rub and brake the other spindle;

a belt lift-off roller supported to the holder, spaced from the pivot of the holder, being near enough to the brake surface and being so shaped that upon pivoting of the holder in the one direction, the belt lift-off roller contacts and raises the belt off the one spindle, and upon pivoting of the holder in the opposite direction, the roller contacts and raises the belt off the other spindle; and means for pivoting the holder in the one and the opposite directions.

2. The spindle brake of claim 1, wherein the means for pivoting comprises a lever attached to the holder and supported on the rail means.

3. The spindle brake of claim 2, wherein the means for pivoting comprises two levers supported on the rail means and each lever being attached at a separated respective location on the holder which is selected such that pulling one of the levers pivots the holder in one direction and pulling the other of the levers pivots the holder in the opposite direction.

4. The spindle brake of claim 3, further comprising a respective brake locking knob on each of the levers; the knob being of a length such that upon the respective lever being pulled a sufficient distance with respect to the rail means, the respective knob may be moved with respect to its lever for also engaging the rail means for preventing return rotation of the holder and for thereby holding the brake surface in braking engagement with the respective contacted spindle.

5. The spindle brake of claim 4, further comprising a respective spring attached to each knob for biasing the knob into engagement with the rail means for thereby preventing return rotation of the holder.

6. The spindle brake of claim 3, wherein the brake element is fastened to the holder to be adjustable for adjusting the position of the brake surface with respect to the pivot of the holder for enabling such shifting of the brake element that the brake surface can engage various spindles of different respective diameters.

7. The spindle brake of claim 6, further comprising fine adjustment means on each of the levers for adjusting the effective length of the lever, whereby the holder will be pivoted to move the lift off roller to lift off the belt from the braked spindle.

8. The spindle brake of claim 7, further comprising a respective brake locking knob on each of the levers and the knob being of a length such that upon the respective lever being pulled a sufficient distance with respect to the rail means, the respective knob may be moved with respect to its lever for also engaging the rail means for preventing return rotation of the holder and for thereby holding the brake surface in braking contact with the respective engaged spindle.

9. The spindle brake of claim 1, wherein the brake element is comprised of resilient material for avoiding excess loading on either of the spindles upon the brake surface contacting that spindle.

10. The spindle brake of claim 9, wherein the brake element is fastened to the holder to be adjustable for adjusting the position of the brake surface with respect to the pivot of the holder for enabling such shifting of the brake element that the brake surface can engage various spindles of different respective diameters.

11. The spindle brake of claim 1, further comprising an engagement device for holding the brake element in a position of rest between the spindles.

12. The spindle brake of claim 1, wherein the brake element is fastened to the holder to be adjustable for adjusting the position of the brake surface with respect to the pivot of the holder for enabling such shifting of the brake element that the brake surface can engage various spindles of different respective diameters.

* * * * *